US006264081B1

(12) United States Patent
Wojciak et al.

(10) Patent No.: US 6,264,081 B1
(45) **Date of Patent: *Jul. 24, 2001**

(54) SAFETY UTILITY BELT

(76) Inventors: Jeffrey J. Wojciak, 7438 S. Beloit; David Lis, 6928 Elder Ct.; Timothy Landingham, 9019 Failane Dr., all of Bridgeview, IL (US) 60455

( * ) Notice: Subject to any disclaimer, the term of this patent is extended or adjusted under 35 U.S.C. 154(b) by 0 days.

This patent is subject to a terminal disclaimer.

(21) Appl. No.: 09/473,728

(22) Filed: Dec. 28, 1999

(51) Int. Cl.[7] ..... A45F 5/00

(52) U.S. Cl. ..... 224/251; 224/660; 224/250; 224/197; 224/904; 2/312

(58) Field of Search ..... 224/242, 250, 224/251, 255, 269, 660, 663, 664, 197, 904; 2/300, 301, 311, 315, 319, 247, 252

(56) References Cited

U.S. PATENT DOCUMENTS

| | | | | |
|---|---|---|---|---|
| 1,486,470 | * | 3/1924 | Welch | 224/664 X |
| 1,642,911 | * | 9/1927 | Thurnau | 224/269 X |
| 4,676,419 | * | 6/1987 | Victor | 224/269 X |
| 4,751,923 | | 6/1988 | Marino . | |
| 4,819,846 | * | 4/1989 | Hannemann | 2/312 X |
| 4,923,105 | | 5/1990 | Snyder . | |
| 5,004,136 | | 4/1991 | Leath . | |
| 5,151,678 | * | 9/1992 | Veltri et al. | 362/103 |
| 5,201,448 | | 4/1993 | Schue . | |
| 5,292,042 | * | 3/1994 | Yamaguchi et al. | 224/663 X |
| 5,413,262 | | 5/1995 | Dewire et al. . | |
| 5,464,136 | * | 11/1995 | Eddy | 2/312 X |
| 5,511,703 | | 4/1996 | Ryerson . | |
| 5,624,065 | * | 4/1997 | Steffe | 2/312 X |
| 5,806,087 | * | 8/1999 | Grotefend | 2/312 X |
| 5,941,438 | * | 8/1999 | Price | 224/660 X |
| 6,015,073 | * | 1/2000 | Wojciak et al. | 224/251 |

* cited by examiner

*Primary Examiner*—Gregory M Vidovich
(74) *Attorney, Agent, or Firm*—Joseph N. Breaux

(57) ABSTRACT

A utility belt that includes a number of retaining rings for securing desirable tools to the utility belt as need that further included a cover strap for each of the retaining rings so that all unused retaining rings can be secured to minimize snagging of the retaining ring and possible death or injury to a user.

1 Claim, 2 Drawing Sheets

SAFETY UTILITY BELT

TECHNICAL FIELD

This application relates to co-pending U.S. patent application Ser. No. 09/168,581 which issued as U.S. Pat. No. 6,015,073 on Jan. 18, 2000. The present invention relates to utility belts for carrying tools and the like and more particularly to a safety utility belt that includes a number of attachment rings that are each provided with a safety cover flap securable over the attachment structure to minimize dangerous snagging of the utility belt when working in confined areas or when in an emergency situation such as while performing firefighting activities; the safety utility belt including a heavy duty webbing back belt, a reflective center belt strip, a buckle assembly, a belt strip end that is coupleable to the buckle assembly to secure the back belt about the waist of a user, a horizontally pivoting tool retaining ring, and a no-snag tool retaining ring safety cover strap securable over the tool retaining ring in a manner to minimize snagging of the tool retaining ring; the no-snag tool retaining ring safety cover strap including a storage hook and pile fastener strip securable to a companionate hook and pile faster section provided on a surface of the back belt when the no-snag tool retaining ring safety cover strap is secured over and through the horizontally pivoting tool retaining ring; the reflective center belt strip being secured to the back belt such that a passageway sized for the passage of a portion of a D-ring is formed between the reflective center belt strip and the back belt.

BACKGROUND ART

While in many jobs, such as firefighting and the like, it is desirable to attach tools of the trade, such as axes, flashlights, hammers, snips, etc, to a utility belt using a number of retaining rings, the retaining rings on the utility belt can sometimes become snagged while in the work environment and lead to injury or death for the worker. It would be a benefit, therefore, to have a utility belt that included a number-of retaining rings for securing desirable tools to the utility belt as need that further included a cover strap for each of the retaining rings so that all unused retaining rings could be covered to prevent snagging of the retaining ring and possible death or injury to a user.

GENERAL SUMMARY DISCUSSION OF INVENTION

It is thus an object of the invention to provide a safety utility belt that includes a number of retaining rings each provided with a safety cover strap securable over the retaining ring to prevent snagging of the retaining ring.

It is a further object of the invention to provide a safety utility belt that includes a back belt, a reflective center belt strip, a buckle assembly, a belt strip end that is coupleable to the buckle assembly to secure the back belt about the waist of a user, a horizontally pivoting tool retaining ring, and a no-snag tool retaining ring safety cover strap securable over and through the tool retaining ring in a manner to minimize snagging of the tool retaining ring; the no-snag tool retaining ring safety cover strap including a storage hook and pile fastener strip securable to a companionate hook and pile faster section provided on a surface of the back belt when the no-snag tool retaining ring safety cover strap is secured over and through the horizontally pivoting tool retaining ring; the reflective center belt strip being secured to the back belt such that a passageway sized for the passage of a portion of a D-ring is formed between the reflective center belt strip and the back belt.

It is a still further object of the invention to provide a safety utility belt that accomplishes some or all of the above objects in combination.

Accordingly, a safety utility belt is provided. The safety utility belt includes a back belt, a reflective center belt strip, a buckle assembly, a belt strip end that is coupleable to the buckle assembly to secure the back belt about the waist of a user, a horizontally pivoting tool retaining ring, and a no-snag tool retaining ring safety cover strap securable over and through the tool retaining ring in a manner to minimize snagging of the tool retaining ring; the no-snag tool retaining ring safety cover strap including a storage hook and pile fastener strip securable to a companionate hook and pile faster section provided on a surface of the back belt when the no-snag tool retaining ring safety cover strap is secured over the horizontally pivoting tool retaining ring; the reflective center belt strip being secured to the back belt such that a passageway sized for the passage of a portion of a D-ring is formed between the reflective center belt strip and the back belt.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
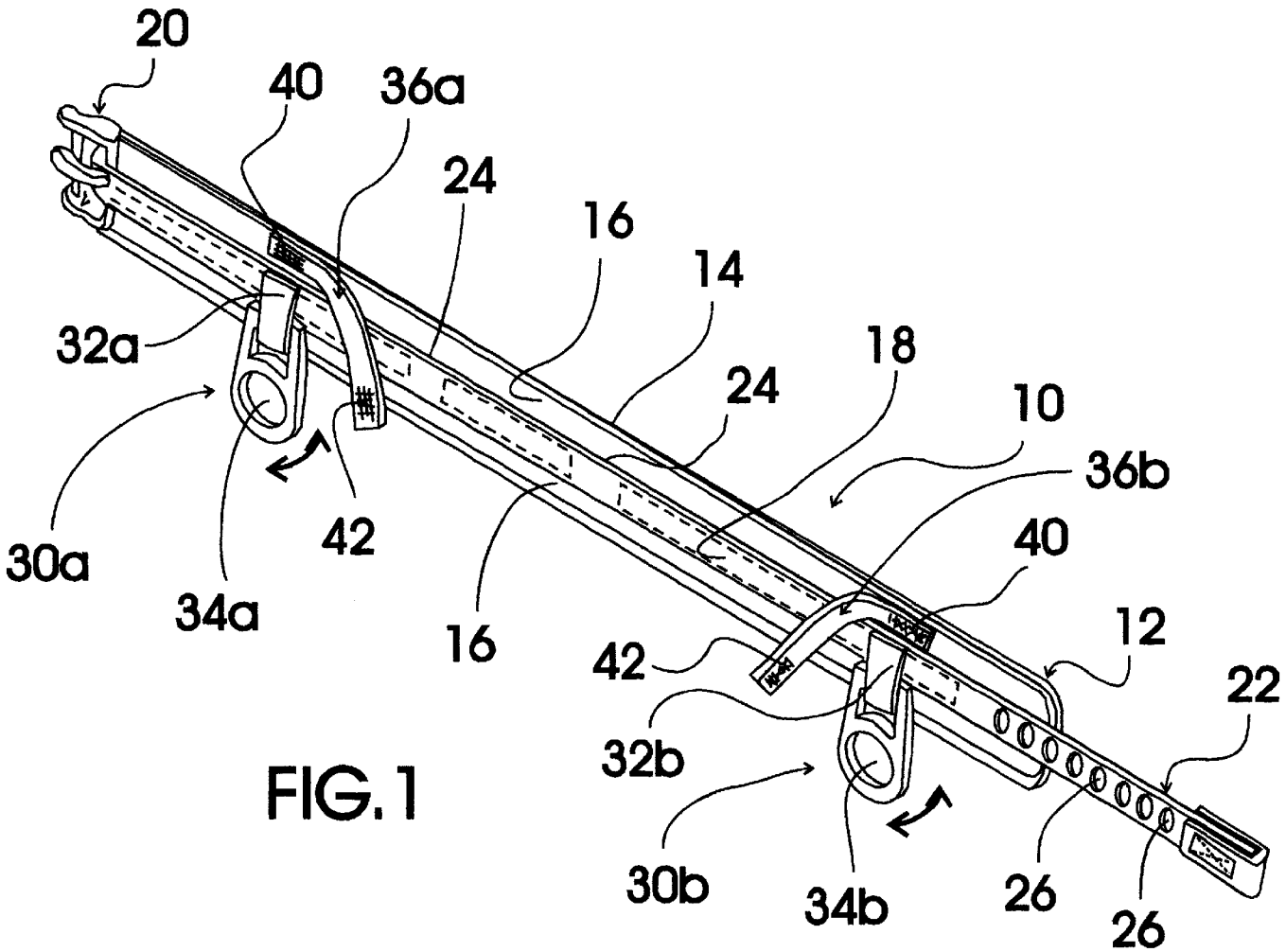
FIG. 1 is a perspective view of an exemplary embodiment of the safety utility belt of the present invention showing the back belt; the reflective center belt strip including the buckle assembly and the grommeted belt strip end; two exemplary horizontally pivoting tool retaining rings each including a no-snag tool retaining ring safety cover strap; and two passageways sized for the passage of a portion of a D-ring formed between the reflective center belt strip and the back belt.

FIG. 1 shows an exemplary embodiment of the safety utility belt of the present invention generally designated by the numeral 10. Safety utility belt 10 includes a back belt 12 icluding a foam pad backed with nylon on the surface 14 adapted to contact the firefighter or other wearer and an outwardly facing, flame resistant reflective surface 16. In this embodiment flame resistant reflective surface 16 is constructed from #M Scotchlite" material having a rating of 500RA.

A center belt strip is stitched to outwardly facing, flame resistant reflective surface 16 of back belt 12 and includes a conventional buckle assembly, generally designated 20 and a belt strap end, generally designated 22 that is coupleable to buckle assembly 20 to secure back belt 12 about the waist of a user using grommeted openings 26. In this embodiment center belt strip 18 is a length of one and three-quarters in wide (1¾") yellow nylon webbing having a minimal tensile strength of 10,000 pounds. Center belt strip 18 is stitched to back belt 12 with bonded nylon thread such that two passageways 24 sized for the passage of a portion of a D-ring 26 (see FIG. 2) are formed between center belt strip 18 and outwardly facing, flame resistant reflective surface 16 of back belt 12.

Two horizontally pivoting tool retaining rings 30*a*,30*b* are each pivotally attached to center belt strip 18 and back belt 12 with a loop of nylon webbing 32*a*,32*b*, respectively, that is stitched to center belt strip 18 and back belt 12 with bonded nylon thread. Each tool retaining ring 30*a*,30*b* has a receiving opening 34*a*,34*b* through which a portion of a tool such as a flashlight, ax, etc. is inserted to free the hands of the wearer. A no-snag tool retaining ring safety cover strap 36*a*,36*b*, respectively, is attached to back belt 12 above each respective loop of nylon webbing 32*a*,32*b* and includes first and second hook and pile faster sections 40,42. Each cover strap 36*a*,36*b* is a section of nylon webbing that has a first end stitched to back belt 12 with bonded nylon thread.

Figure 2:
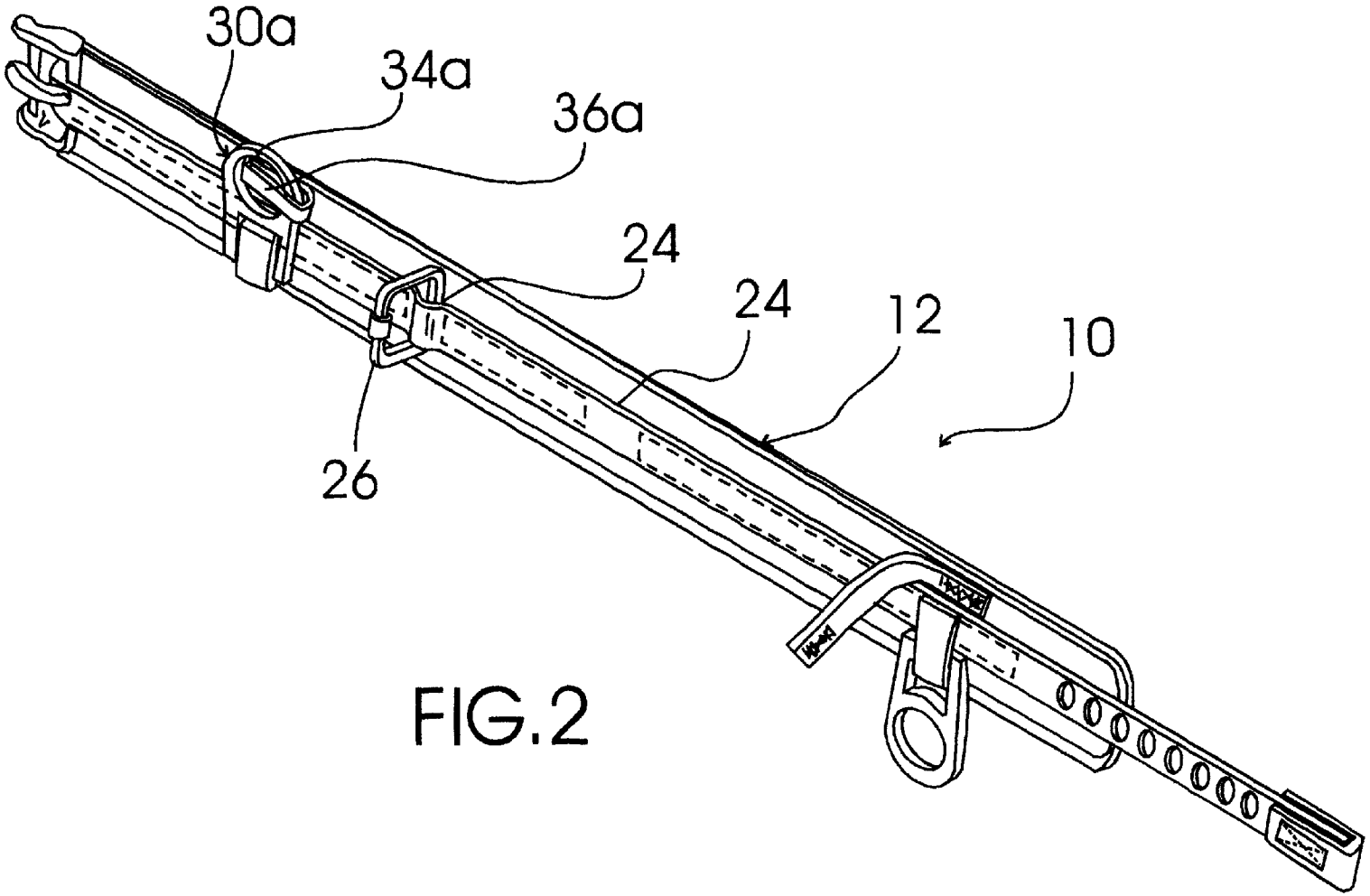
FIG. 2 is a perspective view of the exemplary embodiment of the safety utility belt of FIG. 1 showing one of the two exemplary horizontally pivoting tool retaining rings pivoted into the upward storage position with its respective no-snag tool retaining ring safety cover strap looped over and through the opening of the tool retaining ring and secured by hook and pile faster sections; and a representative D-ring with a position positioned through one of the two passageways sized for the passage of a portion of a D-ring formed between the reflective center belt strip and the back belt.

Referring now also to FIG. 2, in use, each tool retaining ring 30*a*,30*b* is securable to prevent accidental snagging and the like by, for example, pivoting retaining ring 36*a* upward and then folding no-snag tool retaining ring safety cover strap 36*a* over one side of retaining ring 36*a* and through receiving opening 34*a* until hook and pile section 42 contacts and becomes fastened to companionate hook and pile section 40

It can be seen from the preceding description that a safety utility belt 10 has been provided that satisfies the objects enumerated herein above.

It is noted that the embodiment of the safety utility belt described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A safety utility belt comprising:

a back belt having a flame resistant reflective surface;

a center belt strip attached to the reflective surface of the back belt and having a buckle assembly and a belt strip end having openings therethrough that is coupleable to the buckle assembly to secure the back belt about the waist of a user;

a horizontally pivoting tool retaining ring pivotally coupled to said utility belt; and a no-snag tool retaining ring safety cover strap securable over the tool retaining ring in a manner to minimize snagging of the tool retaining ring;

the no-snag tool retaining ring safety cover strap having a first end secured to said utility belt and a second end including a storage hook and pile fastener strip securable to a companionate hook and pile faster section provided on a surface of the cover strap stitched to the back belt when the no-snag tool retaining ring safety cover strap is secured over the horizontally pivoting tool retaining ring;

the reflective center belt strip being secured to the back belt such that a passageway sized for the passage of a portion of a D-ring is formed between the reflective center belt strip and the back belt.

* * * * *